US011591790B2

(12) United States Patent
Deiss

(10) Patent No.: US 11,591,790 B2
(45) Date of Patent: Feb. 28, 2023

(54) SEALING TAPE FOR SEALING A JOINT

(71) Applicant: ISO-Chemie GmbH, Aalen (DE)

(72) Inventor: Martin Deiss, Abtsgmuend (DE)

(73) Assignee: ISO-Chemie GmbH

( * ) Notice: Subject to any disclaimer, the term of this patent is extended or adjusted under 35 U.S.C. 154(b) by 826 days.

(21) Appl. No.: 14/826,271

(22) Filed: Aug. 14, 2015

(65) Prior Publication Data

US 2016/0060863 A1 Mar. 3, 2016

(30) Foreign Application Priority Data

Aug. 26, 2014 (EP) ..... 14182237

(51) Int. Cl.
*E04B 1/68* (2006.01)
*E06B 1/62* (2006.01)

(52) U.S. Cl.
CPC ..... *E04B 1/6812* (2013.01); *E06B 1/62* (2013.01); *E04B 1/6816* (2013.01); *E06B 2001/626* (2013.01)

(58) Field of Classification Search
CPC ..... E04B 1/6812; E04B 1/6816; E06B 1/62; E06B 2001/626
USPC ..... 428/57–63
See application file for complete search history.

(56) References Cited

U.S. PATENT DOCUMENTS 8,541,084 B2 * 9/2013 Deiss ..... E04B 1/6809 428/119
2009/0118401 A1 * 5/2009 Saito ..... C08G 59/685 524/100
2012/0031032 A1 * 2/2012 Deiss ..... E04B 1/6809 52/506.05

FOREIGN PATENT DOCUMENTS

DE 20 2012 005049 U1 8/2013
DE 20 2012 101990 U1 8/2013
DE 202012101990 U1 * 8/2013 ..... E06B 1/62
DE 202001210199 U1 * 10/2013
EP 2065548 A2 6/2009

* cited by examiner

*Primary Examiner* — Maria V Ewald
*Assistant Examiner* — Ethan Weydemeyer
(74) *Attorney, Agent, or Firm* — Jansson Munger McKinley & Kirby Ltd.

(57) ABSTRACT

The sealing tape for sealing a joint comprises two foam strips of flexible foam, which are not formed as integral parts of each other, and which are arranged next to each other in the functional direction of the sealing tape. A film strip is arranged between the foam strips and is bonded to both foam strips. Adhesion sites between the film strips and the first foam strip are arranged only in an upper area of the first foam strip and in a lower area of the first foam strip, whereas, in an intermediate area between the upper area and the lower area of the first foam strip, the film strip is not adhesively bonded to the first foam strip.

25 Claims, 14 Drawing Sheets

SEALING TAPE FOR SEALING A JOINT

CROSS REFERENCE TO RELATED APPLICATION

This application claims priority based on European patent application EP 14 182 237.9 filed Aug. 26, 2014. The entire disclosure and contents of this application are incorporated by reference into the present application.

FIELD

The invention relates to elements for supporting and insulating window frames.

BACKGROUND

The present invention relates to a sealing tape for sealing joints. Sealing tapes unwound from sealing tape rolls are usually used to seal joints between the frame profile of a window, for example, or of a door and the wall of a building to seal off the joints against drafts and driving rain. Films additionally provided on a side surface of the sealing tape, furthermore, increase the impermeability of the tape to water vapor; see, for example, U.S. Pat. No. 4,401,716, US 2010/0009118 A1 or US 2010/0003465 A1. Nevertheless, films which are attached externally to the sealing tape suffer from the disadvantage that they can be damaged during the transport or installation of the sealing tape.

A sealing tape roll which comprises at least one barrier layer extending in the radial direction and which is arranged between two layers of the foam and thus in the interior of the sealing tape roll is known from DE 196 41 415 A1. As a result, the barrier layer is protected more effectively from damage. The barrier layer consists of an adhesive or of a lamination material. To produce a sealing tape of this type, large two-dimensional barrier layers are formed on sheets of an open-pore foam material by lamination or adhesive bonding. Several layers of foam sheets and barrier layers are stacked to form laminate blocks. These laminate blocks are cut into plates at right angles to the large two-dimensional barrier layers. The plates are then wound up into wide rolls in such a way that the barrier layers and the foam material are arranged in a row in the axial direction on the circumference of the rolls. A wide roll of this type is then cut into disks between the individual barrier layers to obtain several sealing tape rolls. This method requires many complicated work steps, and the length of the sealing tapes produced is limited by the size limitation imposed by the laminate blocks, which must be small enough to be processed by machine.

SUMMARY

It is an object of the present invention to provide a sealing tape with an inner film strip, which can be produced easily and reliably with reduced energy consumption and which can expand without restriction after it has been compressed.

According to an aspect of the invention, the sealing tape for sealing a joint comprises two longitudinal side surfaces, wherein a direction transverse to the side surfaces defines a functional direction of the sealing tape. The sealing tape comprises at least a first foam strip and a second foam strip of flexible foam which recovers after compression. The at least two foam strips are not configured as integral parts of each other and are arranged next to each other in the functional direction, wherein each foam strip has a top surface, a bottom surface, and an inner side surface facing the other foam strip. The sealing tape also comprises a film strip, which is arranged between the first foam strip and the second foam strip in such a way that it reduces the permeability of the sealing tape to the diffusion of water vapor in the functional direction, wherein the film strip is adhesively bonded both to the first foam strip and to the second foam strip. Adhesion sites between the film strip and the first foam strip are arranged only in an upper area of the first foam strip, on the top surface of the first foam strip, and/or on the inner side surface of the first foam strip near the top surface of the first foam strip, and also in a lower area of the first foam strip, on the bottom surface of the first foam strip, and/or on the inner side surface of the first foam strip near the bottom surface of the first foam strip, whereas, in the intermediate area between the upper area and the lower area of the first foam strip, the film strip is not bonded to the first foam strip.

With this configuration, a sealing tape is created which can be produced easily and at low cost, in which a barrier layer is arranged protectively in the interior of the foam strip, and in which the sealing tape can expand without restriction in spite of the barrier layer.

The adhesion sites between the film strip and the first foam strip are preferably only on the inner side surface of the first foam strip near the top surface of the first foam strip and on the inner side surface of the first foam strip near the bottom surface of the first foam strip. In this way, it is sufficient, during the production of the sealing tape, merely to heat briefly from above and from below to form the adhesion sites.

A longitudinal pocket is preferably formed between the first foam strip and the second foam strip at the level of the intermediate area of the first foam strip. The film strip forms at least one of the sides of the pocket, which is completely enclosed on at least four sides. This pocket has the advantage that a desired additional material can be accommodated in it in order to give the sealing tape special properties.

In a preferred concrete variant, the pocket is enclosed by the film strip and the first foam strip. In this way, if the adhesion sites between the film strip and the first foam strip are located only in the upper and lower areas of the first foam strip, the pocket is produced automatically during the production of the sealing tape.

In special embodiments, the entire surface of the film strip can be bonded to the inner side surface of the second foam strip.

Alternatively or in addition, the film strip can be bonded to the top surface and/or to the bottom surface of the second foam strip.

An especially simple process for producing the sealing tape is obtained by arranging the adhesion sites between the film strip and the second foam strip only on the inner side surface of the second foam strip near the top surface of the second foam strip and on the inner side surface of the second foam strip near the bottom surface of the second foam strip. In this way, the adhesion sites between the film strip and the first foam strip and the adhesion sites between the film strip and the second foam strip can be produced simultaneously in the same process step.

In another embodiment, the entire surface of the film strip can be bonded to the inner side surface of the second foam strip, and the adhesion sites between the film strip and the first foam strip are arranged on the top surface and on the bottom surface of the first foam strip.

In an alternative embodiment, the sealing tape according to the invention for sealing a joint again comprises two longitudinal side surfaces, wherein a direction transverse to the side surfaces defines a functional direction of the sealing tape. The sealing tape comprises at least a first foam strip and a second foam strip of flexible foam capable of recovering after compression, which two strips are not configured as integral parts of each other and which are arranged next to each other in the functional direction, wherein each foam strip comprises a top surface, a bottom surface, and an inner side surface facing the other foam strip. The sealing tape comprises a first film strip, which is arranged between the first foam strip and the second foam strip in such a way that it reduces the permeability of the sealing tape to the diffusion of water vapor, wherein the first film strip is adhesively bonded to the first foam strip. In addition, a second film strip is provided, which is adhesively bonded to the second foam strip, and the first film strip is adhesively bonded to the second film strip. Adhesion sites between the first film strip and the second film strip are arranged only in an area near the top surface of the first foam strip and in an area near the bottom surface of the first foam strip, whereas, in an intermediate area between the adhesion sites, the first film strip and the second film strip are not bonded to each other.

In this way, the foam strips can already be equipped with the first film strip and the second film strip in an upline production step, and the bonding of the two so-equipped foam strips together is achieved simply by bonding the two film strips together in a later method step.

At least one longitudinal pocket is preferably formed in the intermediate area between the adhesion sites and thus between the first film strip and the second film strip, which pocket is completely enclosed on at least four sides. This has the advantage that a suitable additional material can be introduced into the pocket to give the sealing tape additional desired properties.

In a special embodiment, the first film strip is bonded to the top surface and to the bottom surface of the first foam strip, and the second film strip is adhered to the top surface and to the bottom surface of the second foam strip.

Alternatively or in addition, the entire surface of the first film strip can be bonded to the inner side surface of the first foam strip, and the entire surface of the second film strip can be bonded to the inner side surface of the second foam strip.

In all of the embodiments, it is preferable for the adhesion sites to be configured as longitudinal adhesion lines. This ensures that the two foam strips are bonded to each other continuously along their lengths, a step which is also easy to accomplish.

In preferred embodiments, the pocket is filled with an additional material.

An especially easy way of producing the sealing tape according to the invention is obtained by forming the adhesion sites by melting and then solidifying a bonding material, especially an adhesive.

BRIEF DESCRIPTION OF THE DRAWINGS

Additional properties and advantages of the present invention can be derived from the following description, which refers to the drawings.

DETAILED DESCRIPTION

Figure 1A:
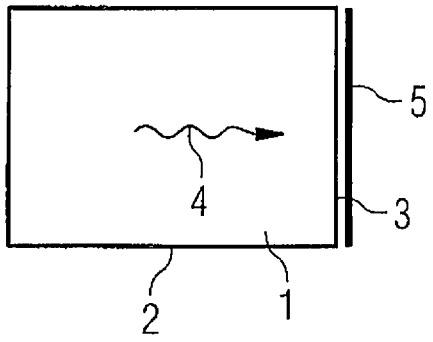
FIG. 1 shows a cross section through one embodiment of the sealing tape according to the invention.

FIGS. 1-12 show cross-sectional schematic diagrams of examples of various embodiments of the sealing tape 2 according to the invention in the completely expanded state. It should be pointed out that the individual elements of sealing tape 2 shown in the figures are drawn as if they were a certain distance apart for the sake of clarity and so that the individual elements can be labeled more clearly. In reality, the individual elements of sealing tape 2 lie closely against each other.

The adhesion sites 132, for the sake of clarity, are drawn as block-shaped elements, but in reality they are usually flat, nearly dot-like, linear, or two-dimensional formations, which allow the adjacent elements in question to lie very closely together. Adhesion sites 132 can also be integrated into an element adjacent to them or can be fused to such an element.

The embodiments of sealing tape 2 shown in FIGS. 1-12 can be produced as sealing strips or preferably as a sealing tape roll. In both cases, sealing tape 2 extends farther in a direction proceeding into the plane of the drawing (longitudinal direction) than in the transverse direction, which extends from the left side surface 104 of sealing tape 2 to the right side surface 104. In the case of a sealing tape roll, sealing tape 2 is wound up in compressed form into a coil, wherein adjacent turns of the sealing tape roll rest directly against each other.

Figure 1B:
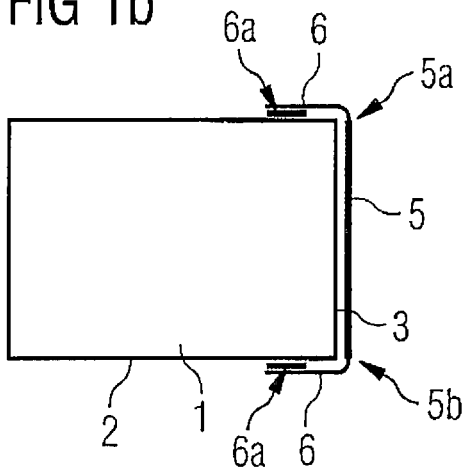
Figure 2A:
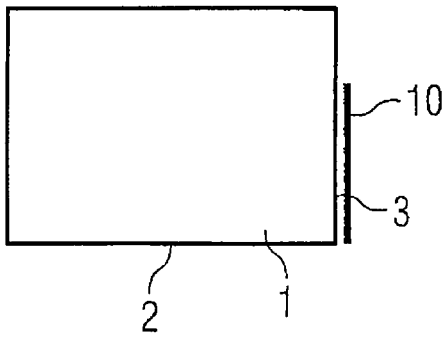
FIG. 2 shows a cross section through another embodiment of the sealing tape according to the invention.
Figure 2B:
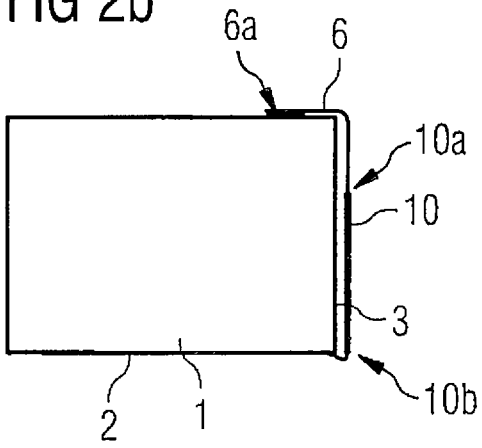

The embodiment of sealing tape 2 shown in FIGS. 1-2 comprises a first foam strip 114 and a second foam strip 116, which are arranged next to each other in the functional direction F. Functional direction F defines the direction in which the passage of air and/or the permeability to vapor diffusion through sealing tape 2 is to be reduced. Functional direction F in the present case proceeds in the transverse direction of sealing tape 2 from one side surface 104 of sealing tape 2 to the other side surface 104 of sealing tape 2.

The width of sealing tape 2 in the transverse direction between outer side surfaces 104 is usually in the range between 5 millimeters and 20 centimeters, and preferably in the range of 1-12 centimeters. The width of foam strip 114, 116 is preferably in the range of 2.5-150 millimeters, and more preferably in the range of 10-80 millimeters. The thickness of foam strip 114, 116 in the expanded state is usually in the range of 5-150 millimeters, and more preferably in the range of 10-80 millimeters. Inside sealing tape 2, first foam strip 114 can also have a different width and/or thickness than second foam strip 116.

Any of the known open-cell, mixed-cell, or closed-cell flexible foams of, for example, polyurethane, polyethylene, polyvinyl chloride, or polypropylene which recover after compression can be used as foam for foam strips 114, 116.

For the further adaptation of the sealing properties of sealing tape 2, first foam strip 114 can be made of a foam material which is different from that of second foam strip 116. First foam strip 114 and second foam strip 116 can also be impregnated with different impregnation agents, or only first foam strip 114 or only second foam strip 116 can be impregnated. In another exemplary embodiment, first foam strip 114 can have a different color than second foam strip 116. This makes it possible, for example, to identify the preferred installation direction of sealing tape 2.

In the present example, first foam strip 114 and second foam strip 116 are essentially identical in form; in particular, they have the same thickness and the same width. The two foam strips 114, 116 are not formed as integral parts of one another; that is, there is no connecting web of foam material between the two foam strips 114, 116. Instead, two foam strips 114, 116 are merely bonded, directly or indirectly, to each other.

In the example shown here, first foam strip 114 comprises a rectangular cross section. First foam strip 114 comprises a top surface 118, a bottom surface 120, and an inner side surface 122 facing second foam strip 116. Opposite inner side surface 122 of first foam strip 114, first foam strip 114 comprises an outer side surface, which coincides with side surface 104 of sealing tape 2. In the example show here, second foam strip 116 also comprises a rectangular cross section. Second foam strip 116 comprises a top surface 124, a bottom surface 126, and an inner side surface 128 facing first foam strip 114. Outer side surface of second foam strip 116 opposite inner side surface 128 simultaneously forms second side surface 104 of sealing tape 2.

In addition to the rectangular cross-sectional shape shown, each of foam strips 114, 116 could also have a different cross-sectional form, in which top surface 118, 124 of one or both foam strips 114, 116 is provided with a profile of any desired shape.

Between first foam strip 114 and second foam strip 116, a film strip 130 is arranged in such a way that it reduces or even completely blocks the permeability of the sealing tape to vapor diffusion in functional direction F.

Film strip 130 is preferably made of plastic (polyamide, polyethylene, polypropylene, polyurethane, etc.). Other materials which are adapted to reducing the passage of air or the diffusion of vapor through sealing tape 2 can also be used. It is possible to block the passage of air the diffusion of vapor completely, but this is not absolutely necessary. It can be advisable for film strip 130 to be "moisture-variable," in the sense that it is more resistant to diffusion at high humidity than at low humidity or vice versa.

With respect to the materials usable for film strip 130, reference can be made, for example, to EP 2 733 271 A1, the content of which is fully incorporated by reference in the present application.

In the example of FIG. 1, film strip 130 runs vertically down the entire inner side surface 128 of second foam strip 116. In the example shown, the entire surface of film strip 130 is bonded by way of an adhesive surface 131 to inner side surface 128 of second foam strip 116. Adhesive surface 131 is preferably formed by lamination.

Conversely, film strip 130 is connected to first foam strip 114 merely by means of certain adhesion sites 132. Adhesion sites 132 in the example of FIG. 1 are located merely in an upper area 117 of first foam strip 114, i.e., on inner side surface 122 of first foam strip 114 near top surface 118 of first foam strip 114, and in a lower area 119 of first foam strip 114, i.e., on inner side surface 122 of first foam strip 114 near bottom surface 120 of first foam strip 114. In an intermediate area 121 between upper area 117 and lower area 119 of first foam strip 114, however, film strip 130 is not bonded to first foam strip 114.

Upper area 117, intermediate area 121, and lower area 119 of first foam strip 114 are made clear by the dotted lines. In the expanded state of sealing tape 2, the height of intermediate area 121 is preferably equal to at least 10% of the thickness of the entire sealing tape 2 and more preferably to at least 20%-60%. Upper area 117 and lower area 119, conversely, are preferably less high/less thick and are preferably essentially of the same thickness.

Adhesion sites 132 are preferably formed as continuous adhesion lines in the longitudinal direction of sealing tape 2, so that, between adhesion sites 132 a pocket 134 is formed which is enclosed by other elements of sealing tape 2 on at least four sides. In the example shown, film strip 130 and inner side surface 122 of first foam strip 114 (supported by adhesion sites 132) form the boundaries of pocket 134.

It should be mentioned that pocket 134 does not have a large transverse dimension. On the contrary, pocket 134 will in practice be noticeable only as a narrow slot between two foam strips 114, 116. Pocket 134 will usually be accessible from the front and from the rear, that is, in the direction extending out from the plane of the drawing and in the direction extending into the plane of the drawing.

Adhesion sites 132 are preferably formed by melting and then solidifying an adhesive. It is especially preferred that the hot-melt adhesive be integrated as a component, especially in the form of a layer, into film strip 130, so that it can be activated during the production process merely by heating it and then allowing it to solidify. In this way, the step of applying an additional adhesive material can be omitted. It is also preferable for film strip 130 itself to have thermoplastically adhesive properties, so that the material of film strip 130 can be heated to melt it, whereupon film strip 130 can be bonded adhesively to adjacent elements, and the material can then be solidified.

In addition to the properties of reducing or preventing vapor diffusion, it is especially important that each barrier layer 130 be permanently elastic, so that, even after storage of sealing tape roll 2 in the compressed state, it continues to behave elastically during the recovery of sealing tape 2 and at all times rests tightly against the sides of the joint after sealing tape 2 has been installed in a joint.

Adhesive layer 80, covered by a peel-off film 81, furthermore, is applied to bottom surface 126 of sealing tape 2. Adhesive layer 80 serves to attach sealing tape 2 to the structural component to be sealed, as will be described in greater detail below with reference to FIG. 13. Adhesive layer 80 of this type with peel-off film 81 is preferably also present in the embodiments of FIGS. 2-12, but for the sake of clarity is not illustrated in those cases.

The variant of sealing tape 2 according to the invention shown in FIG. 2 corresponds essentially to the embodiment of FIG. 1. Here, however, film strip 130 does not only extend over inner side surface 128 of second foam strip 116 but is also folded over top surface 124 and bottom surface 126 of the second foam strip 116, where it is then also bonded in place by means of adhesive areas 131.

Figure 3A:
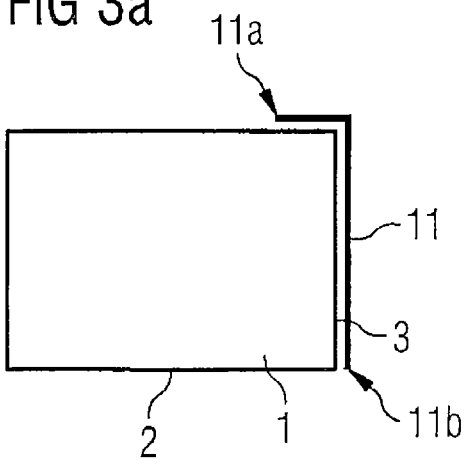
FIG. 3 shows a cross section through another embodiment of the sealing tape according to the invention.
Figure 3B:
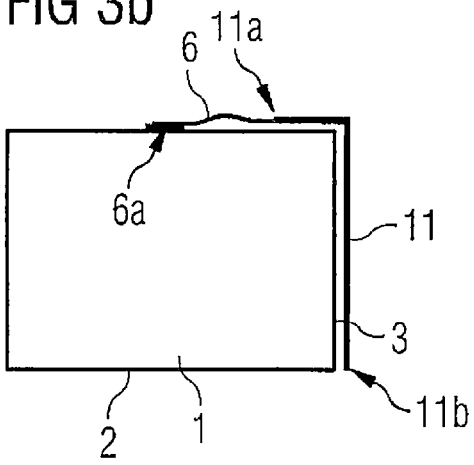

The variant of sealing tape 2 according to the invention shown in FIG. 3 is essentially the same as the embodiment of FIG. 2, except that here film strip 130 is bonded only to top surface 124 and to bottom surface 126 of second foam strip 116, whereas it is no longer bonded to inner side surface 128 of second foam strip 116.

Figure 4:
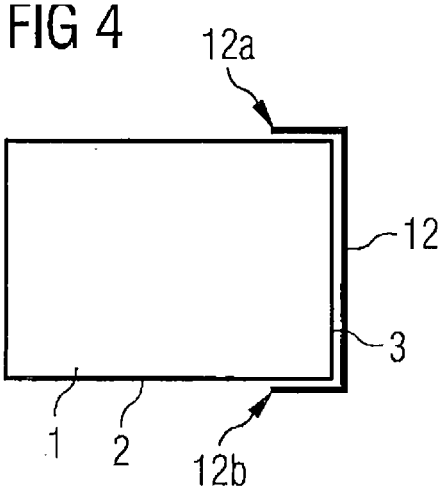
FIG. 4 shows a cross section through another embodiment of the sealing tape according to the invention.

The variant of sealing tape 2 according to the invention shown in FIG. 4 is essentially the same as the embodiment of FIG. 1, except that here the entire surface of film strip 130 is no longer bonded to inner side surface 128 of second foam strip 116 but instead is bonded merely by way of adhesion sites 132. These adhesion sites 132 are arranged on inner side surface 128 of second foam strip 116, i.e., near top surface 124 of second foam strip 116, and on inner side surface 128 of second foam strip 116, i.e., near bottom surface 126 of second foam strip 116. Thus, sealing tape 2 has a mirror-symmetric configuration with respect to the plane of film strip 130. In the intermediate area between adhesion sites 132, film strip 130 is not bonded to second foam strip 116.

In the embodiment shown here, it is advantageous for film strip 130 to have been already equipped on both sides with a layer of hot-melt adhesive and/or for the film strip itself to be thermoplastically adhesive, so that, when it is heated and then solidified, all of adhesion sites 132 are formed simultaneously.

Figure 5:
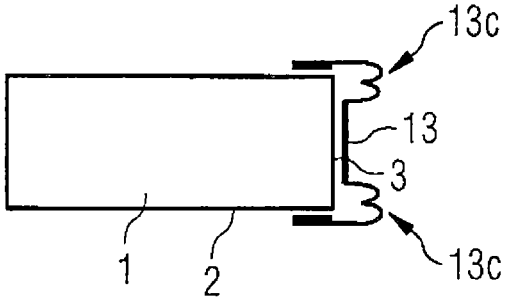
FIG. 5 shows a cross section through another embodiment of the sealing tape according to the invention.

The variant of sealing tape 2 according to the invention shown in FIG. 5 is essentially the same as the embodiment of FIG. 4, except that, here, a second film strip 136 is introduced between film strip 130 and second foam strip 116; this second strip is itself bonded by way of adhesion sites 132 to second foam strip 116. The material of second film strip 136 is preferably selected from the same materials as those which can be considered as material for film strip 130.

By means of adhesion sites 132, second film strip 136 is thus bonded on one side to second foam strip 116 and on the other side to film strip 130. It is also possible for the bond between second film strip 136 and second foam strip 116 to be achieved by bonding the entire surface of the film strip to inner side surface 128 of second foam strip 116. In the embodiment shown in FIG. 5, therefore, in addition to pocket 134, which is arranged between film strip 130 and first foam strip 114, two additional pockets are formed: one between two film strips 130 and 136, and another pocket between second film strip 136 and second foam strip 116.

Figure 6A:
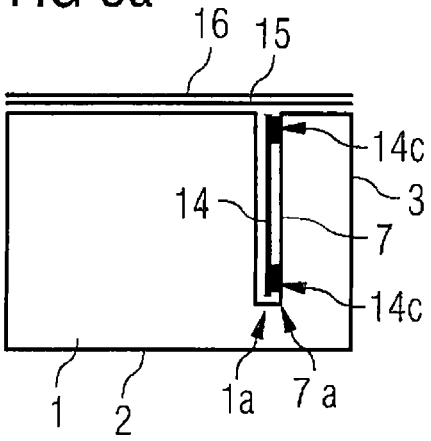
FIG. 6 shows a cross section through another embodiment of the sealing tape according to the invention.
Figure 6B:
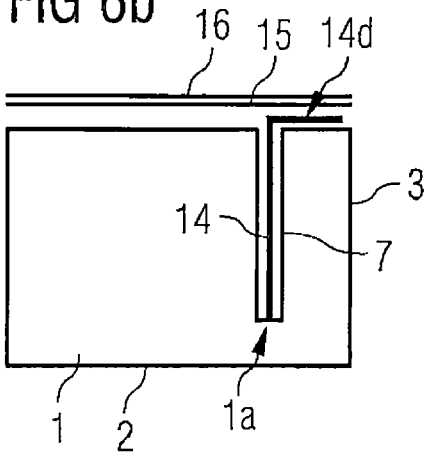
Figure 6C:
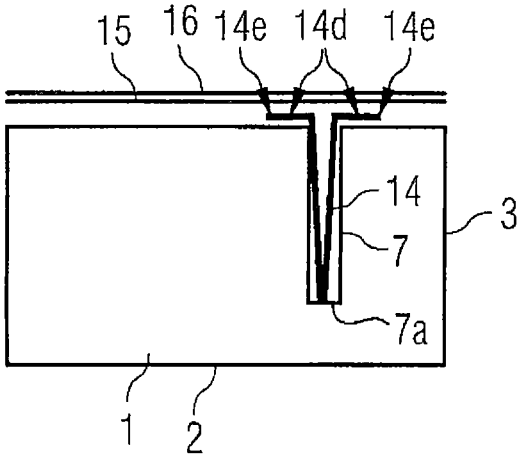

In the variant of sealing tape 2 according to the invention shown in FIG. 6, the configuration is similar to that of the embodiment of FIG. 5; here, however, only one film strip 130 is provided, which is arranged in the shape of a "U" between two foam strips 114, 116, and the side surfaces of which are bonded by way of adhesion sites 132 to inner side surface 122 of first foam strip 114 and to inner side surface 128 of second foam strip 116. In addition, as shown in FIG. 6, the two side surfaces of film strip 130 can also be bonded to each other by means of an additional adhesion site 132 in an upper area of sealing tape 2.

Figure 7:
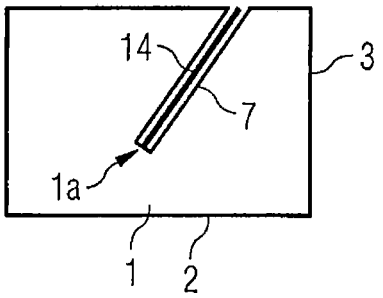
FIG. 7 shows a cross section through another embodiment of the sealing tape according to the invention.

The variant of sealing tape 2 according to the invention shown in FIG. 7 is essentially the same as the embodiment of FIG. 1, except that film strip 130 is not bonded to inner side surface 122 of first foam strip 114 but rather only to first foam strip 114 by adhesion sites 132, which are arranged on top surface 118 and bottom surface 120 of first foam strip 114.

Figure 8A:
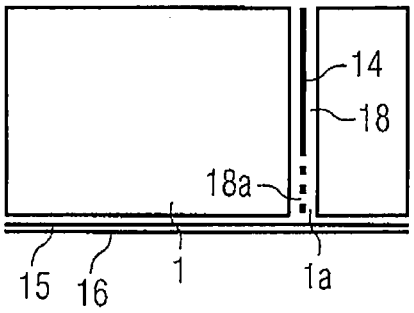
FIG. 8 shows a cross section through another embodiment of the sealing tape according to the invention.
Figure 8B:
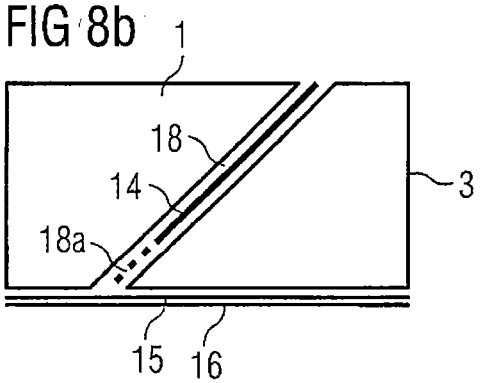
Figure 8C:
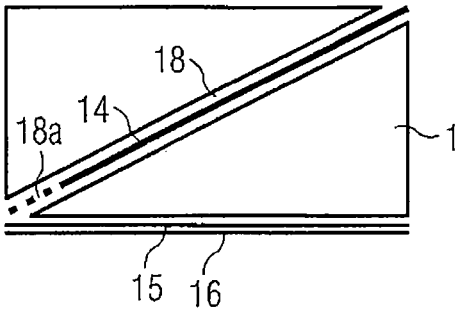

The variant of sealing tape 2 according to the invention shown in FIG. 8 is the same as the embodiment of FIG. 1, wherein pocket 134 is filled with an additional material 140. Cohesive materials, which can be introduced in one piece into pocket 134, are especially suitable as additional material 140.

Pourable or liquid materials come under consideration primarily when pocket 134 is also sealed in the directions proceeding out of the plane of the drawing and into the plane of the drawing, that is, when pocket 134 is enclosed on all six sides, or when in the case of a pocket 134 enclosed on four sides, sealing tape 2 is used in long pieces, so that the amount of material which escapes from the open ends is insignificant overall.

Materials for fire protection (e.g., expanded graphite, noncombustible solids, $CO_2$ emitters, etc.), materials for insulation (e.g., polyurethane foam, resins, sealants, etc.), materials for sealing out moisture (e.g., hydrophobic or hydrophilic substances, substances which swell on contact with water, etc.), sound-damping materials, materials for controlled venting (e.g., catalysts, etc.), hygienic materials (e.g., disinfectants, etc.), and/or materials for initiating the expansion of the sealing tape (e.g., blowing agents, heat sources, etc.).

The introduction of an additional material 140 into pocket 134 is possible in principle in all of the embodiments of sealing tape 2 according to the invention.

Figure 9:
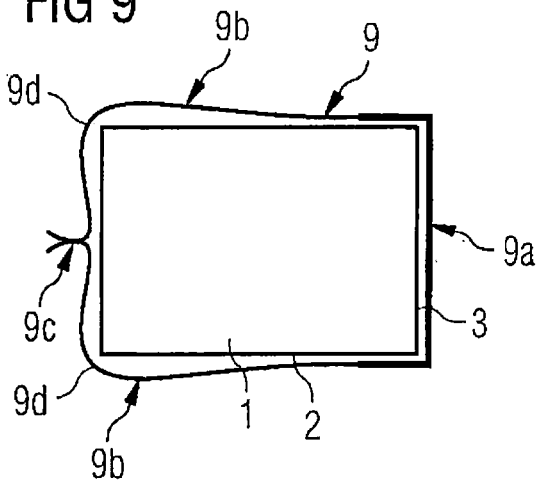
FIG. 9 shows a cross section through another embodiment of the sealing tape according to the invention.

The variant of sealing tape 2 according to the invention shown in FIG. 9 is essentially the same as the embodiment of FIG. 1, wherein the entire surface of first film strip 130 is bonded to inner side surface 122 of first foam strip 114 by means of an adhesive surface 131. In addition, a second foam strip 136 is provided, the entire surface of which is bonded to an inner side surface 128 of second foam strip 116 by means of an adhesive surface 131. In this embodiment, first film strip 130 and second film strip 136 are bonded to each other by adhesion sites 132, which are arranged only in an area near top surface 118 of first foam strip 114 and in an area near bottom surface 120 of first foam strip 114, whereas, in an intermediate area 138 between adhesion sites 132, first film strip 130 and second film strip 136 are not bonded to each other.

When adhesion sites 132 are for their own part configured as continuous, longitudinal adhesion lines, longitudinal pocket 134 is formed in intermediate area 138 between adhesion sites 132 and thus between first film strip 130 and second film strip 136, this pocket again being completely enclosed on at least four sides.

Figure 10:
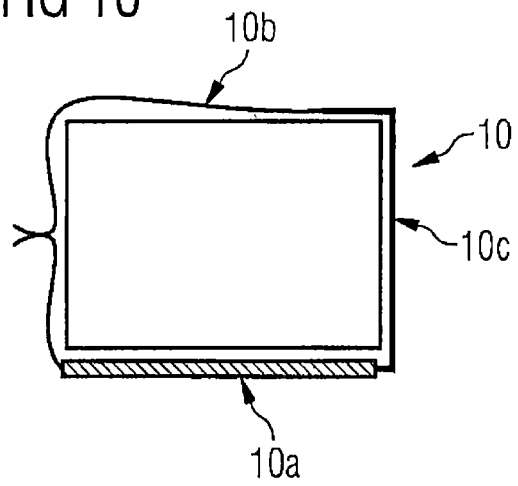
FIG. 10 shows a cross section through another embodiment of the sealing tape according to the invention.

The variant of sealing tape 2 according to shown in FIG. 10 is essentially the same as the configuration described in conjunction with FIG. 9, except that here first film strip 130 is also folded over onto top surface 118 and onto bottom surface 120 of first foam strip 114 and bonded there by means of adhesive surfaces 131. In addition, second foam strip 136 is also folded over onto top surface 124 and onto bottom surface 126 of second foam strip 116 and bonded there by means of adhesive surfaces 131.

Figure 11:
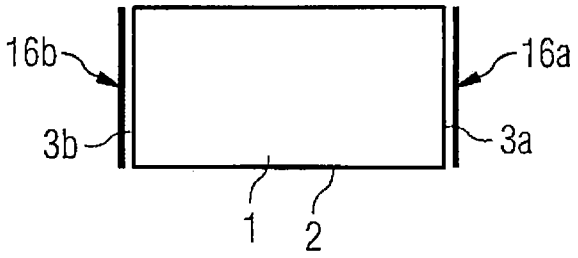
FIG. 11 shows a cross section through another embodiment of the sealing tape according to the invention.

The variant of sealing tape 2 according to the invention shown in FIG. 11 is essentially the same as the embodiment of FIG. 10, except that here first film strip 130 is no longer bonded to inner side surface 122 of first foam strip 114, and second film strip 136 is no longer bonded to inner side surface 128 of second foam strip 116.

Figure 12:
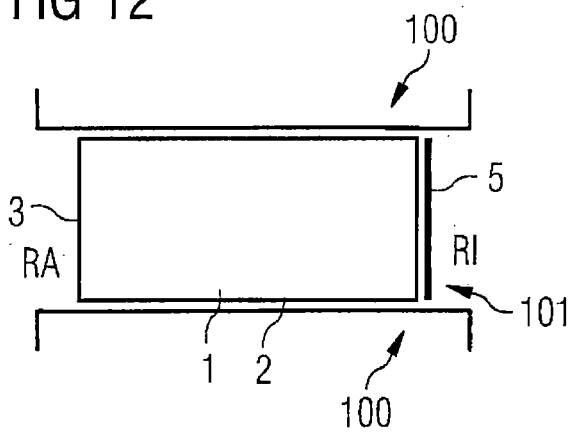
FIG. 12 shows a cross section through another embodiment of the sealing tape according to the invention.

The variant of sealing tape 2 according to the invention shown in FIG. 12 is the same as the embodiment of FIG. 9, except that here pocket 134 is now filled with an additional material 140, as previously explained above with reference to FIG. 8.

In principle, the properties explained in conjunction with FIG. 1 apply to all of adhesive surfaces 131 and to all of adhesion sites 132 in all of the embodiments.

In principle, it would also be possible to arrange several foam strips 114, 116 next to each other and to bond them in the manner according to the invention. In any case, at least one film strip 130 should be arranged between each pair of foam strips 114, 116. In principle, sealing tapes 2 of any desired configuration can be produced, wherein foam strips 114, 116 and film strips 130 preferably alternate in functional direction F, and a foam strip 114, 116 is preferably arranged at each edge of sealing tape 2.

It is also conceivable that, in a tape with more than two foam strips 114, 116, two outer foam strips 114, 116 could be only half as wide as inner foam strips 114, 116.

Figure 13:
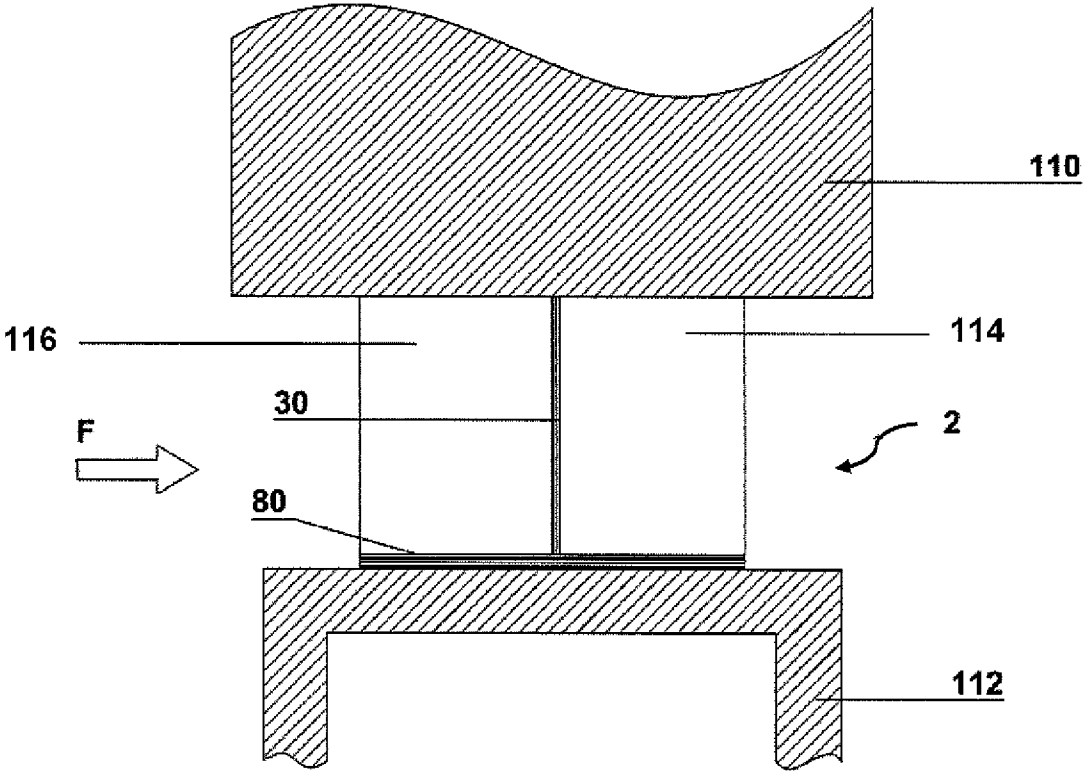
FIG. 13 shows a schematic diagram of an installation situation of the sealing tape according to the invention.

FIG. 13 shows an installation situation of a sealing tape 2 according to the invention, which has been unwound from a sealing tape roll. The installation situation is intended in principle to apply to all embodiments of sealing tape 2 according to the invention. To this extent, reference number 30 stands here in general for a barrier layer, which is formed in most of the exemplary embodiments by film strip 130, but which can also be formed by a combination of film strips 130 and additional material 140, and also by a combination of a film strip 130 and a second film strip 136 or by a combination of a film strip 130, a second film strip 136, and additional material 140. Instead of additional material 140, pocket 134 can simply be filled with air alone. All of these possibilities are summarized by the term "barrier layer 30".

For the purpose of installation, sealing tape 2 will usually have to be unrolled from the sealing tape roll first and then cut into strips of the desired length. The length of the sealing tape strips will usually be adapted to the external contours of the window frame or door frame to be sealed. Sealing tape 2 is then preferably attached to window frame 112 or door frame by means of adhesive layer 80 or by means of other adhesive layers, adhesive tape strips, or other suitable means. When a double-sided adhesive tape strip is used as adhesive layer 80, therefore, it is necessary merely to remove peel-off film 81, before sealing tape 2 can be attached directly to window frame 112.

In the installation situation shown in FIG. 13, sealing tape 2 is accommodated between a window frame 112 and masonry 110 to seal off the joint between them. Barrier layer 30 is accommodated for protection between foam strips 114, 116, as a result of which damage to sealing tape 2 during storage, transport, and installation is avoided. Sealing tape 2 is to be installed in such a way that at least one barrier layer 30 extends from window frame 112 to masonry 110 and thus essentially at a right angle to functional direction F of sealing tape 2. Functional direction F extends here from the outside of the room (on the left in FIG. 13) to the inside of the room (on the right in FIG. 13), parallel to the surfaces of window frame 112 and of masonry 110 forming the joint to be sealed. In this way, a reliable seal against drafts and vapor diffusion can be guaranteed.

Figure 14:
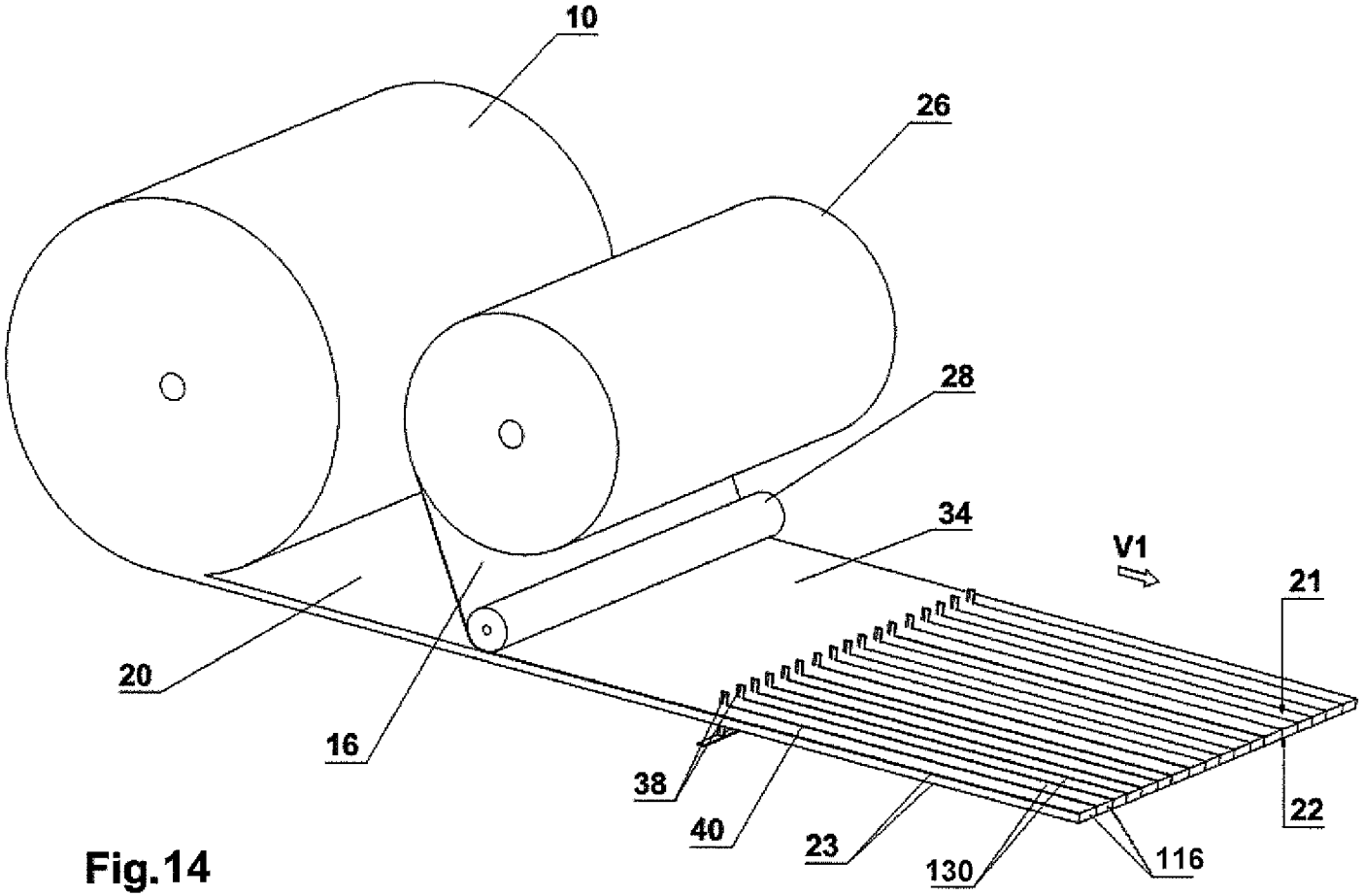
FIGS. 14-16 show schematic diagrams of possible production methods for one embodiment of the sealing tape according to the invention.
Figure 15:
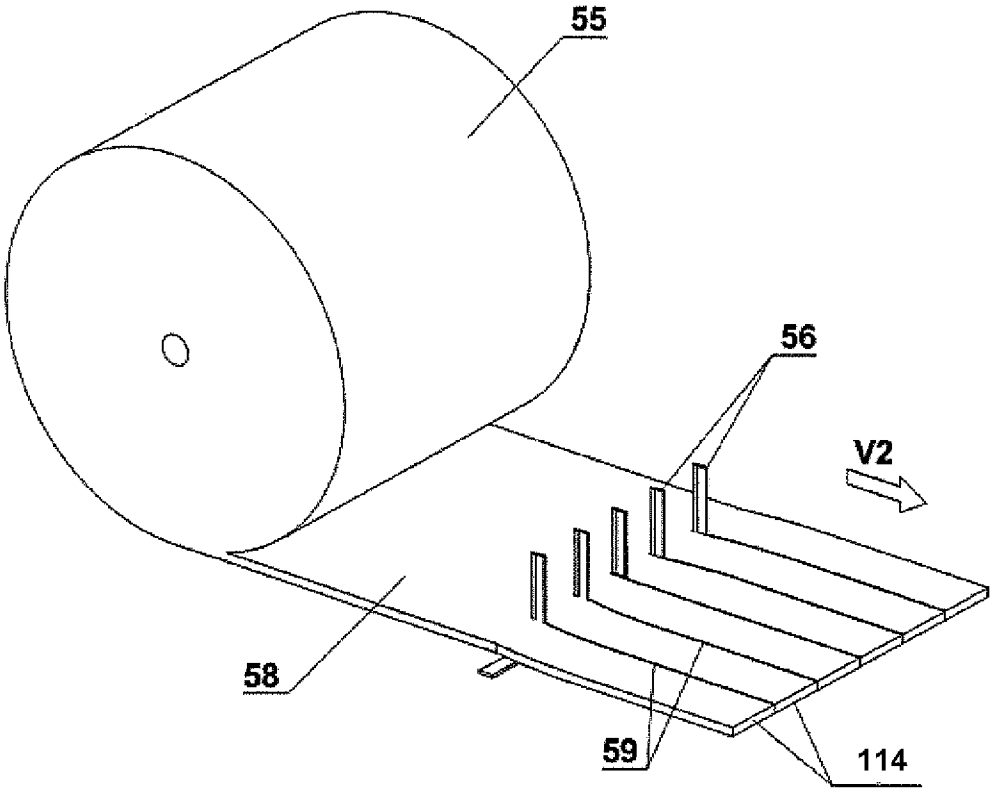
Figure 16:
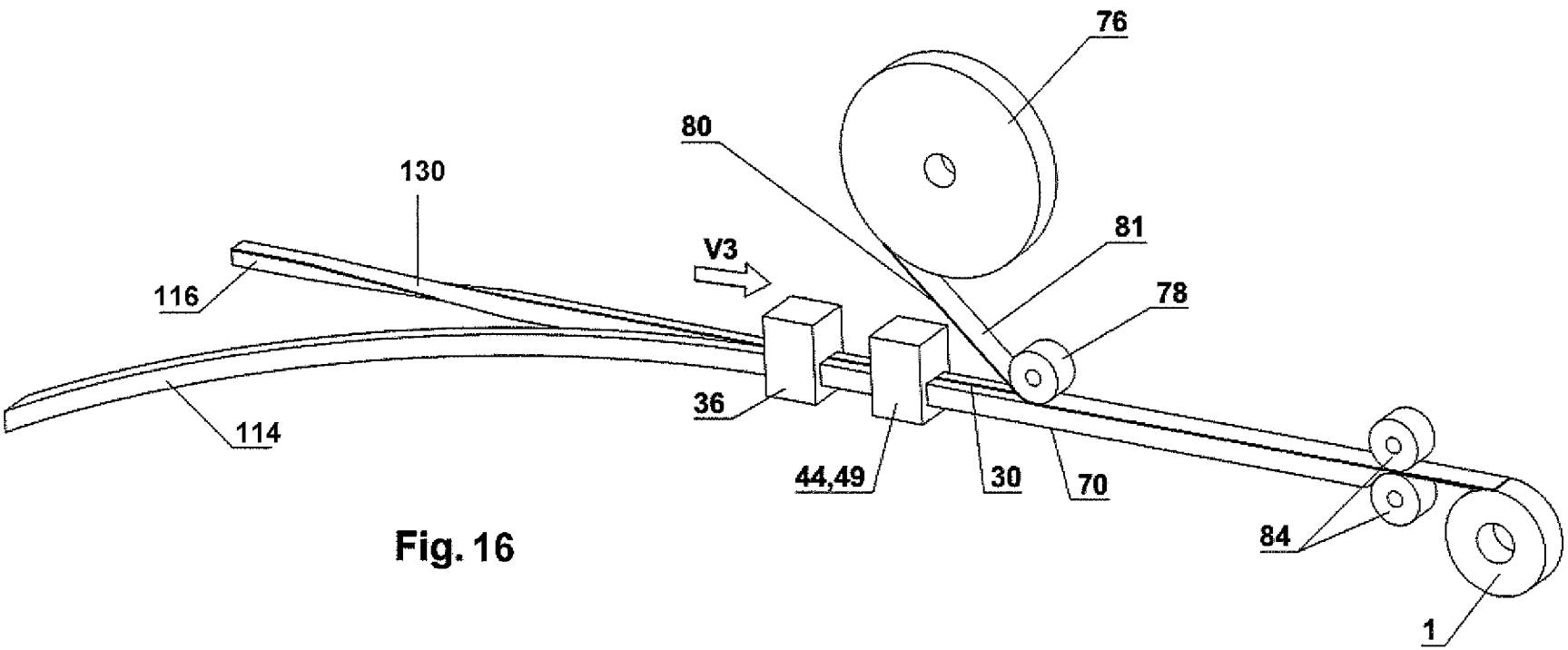

In FIGS. 14-16, a first possible way of producing a sealing tape 2 according to the invention is shown. This method is adapted in particular to the embodiments of FIGS. 1 and 9.

FIG. 14 shows first optional steps of the possible production method. A flexible foam in the form of a wound-up foam web 20 is provided on a roll 10. The flexible foam is provided on the roll 10 in long lengths of up to 200 meters, preferably of 5-100 meters, and more preferably of 10-60 meters. Foam web 20 may already have been impregnated before the further processing but preferably it has not been impregnated.

Because foam web 20 is provided in the form of a roll 10, it can be transported and processed very easily. As a rule, foam web 20 is present on roll 10 in an uncompressed state or in an only slightly compressed state. It is also possible for foam web 20 to be on roll 10 in a compressed state, but then, after it has been unwound from roll 10, it must be ensured that the foam material will recover its original shape in time during the course of the process. The width of foam web 20 will usually be in the range between 1 centimeter and 5 meters, and preferably in the range of 1.0-1.5 meters.

Alternatively, it is equally possible to provide individual foam webs 20 which are not wound up into a roll 10, as a result of which, however, a larger amount of space is required to provide them.

After foam web 20 has been unwound from roll 10, it is moved in a first conveying direction, as identified by arrow V1. Then a film web 16 is applied to top surface 21 of foam web 20 to form a lined foam web 34.

In FIG. 14, film web 16 is provided on a film supply roll 26. Film web 16 is preferably applied from above to top surface 21 of foam web 20. This is usually done in the area of a first bonding unit, which is indicated schematically by roller 28. Film web 16 is preferably laminated to foam web 20. The bonding step usually comprises, in general, a step of pressing film web 16 and foam web 20 against each other.

Film web 16 itself can also comprise a layer of an adhesive tape strip or a layer of a hot-melt adhesive. It is also possible to apply a spray adhesive to film web 16.

In alternative exemplary embodiments, film web 16 can also be applied from below to bottom surface 22 of foam web 20. According to another exemplary embodiment, film webs 16 are applied to top surface 21 and to bottom surface 22 of foam web 20.

By means of at least one knife 38, preferably several parallel knives 38, at least one continuous cut 40, preferably several parallel continuous cuts 40, are introduced into lined foam web 34 in the longitudinal direction of lined foam web 34, and preferably parallel to longitudinal edges 23 of lined foam web 34. Longitudinal edges 23 are the edges of the lined foam web 34 which are parallel to the conveying direction V1 and at a right angle to the axial direction of roll 10. To introduce the at least one continuous cut 40 into foam web 20, it is possible to use, instead of knives 38, any of the methods known to the person skilled in the art for cutting foam webs 20 such as cutting by means of saws, heated wires, laser cutting devices, or water-jet cutting devices.

Continuous cuts 40 produce a plurality of second foam strips 116, each of which is provided with a film strip 130. Second foam strips 116 produced by the at least one cut 40 can be of different widths, but preferably they are all of the same width. Second foam strips 116 can be wound up at this point onto a supply roll (not shown), so that they can be stored until needed for further processing, which thus allows the length of the production line to be reduced, or they can be sent on directly to further processing. Overall, through the use of supply rolls as intermediate storage, the number of successive steps in the production line can be varied, and thus the length of the individual subsections of the production line can be adapted as appropriate to the amount of space available.

It is also conceivable that foam web 20 could be cut first into foam strips 116, and individual foam strips 116 could then be equipped with film strips 130. In this case, it would also be possible to produce other embodiments of sealing tape 2 according to the invention.

FIG. 15 shows an example of an optional sequence of steps in the production of first foam strips 114. For this purpose, a foam web 58 of flexible foam is provided, preferably uncompressed, on a roll 55. After the foam web 58 has been unwound from roll 55 it is moved in a second conveying direction V2. As for the type of foam, the above about foam web 20 also applies here.

By means of at least one knife 56, preferably several parallel knives 56, at least one continuous cut 59, preferably several parallel continuous cuts 59, are introduced into foam web 58 in a direction parallel to the longitudinal edges of foam web 58. The at least one continuous cut 59 thus produces a plurality of first foam strips 114. Here as well, instead of knives 56, any other method known to the person skilled in the art for cutting foam webs can be used, such as cutting by means of saws, heated wires, laser cutting devices, or water jet cutting devices. It is also possible here to provide foam web 58 without having wound it up into a roll 55 first. First foam strips 114 can be wound up at this point into a supply roll (not shown) or sent on directly for further processing. Finally, first foam strips 114 can also be provided individually. First foam strips 114, furthermore, can also be provided with a film strip 130 on at least one side surface, in the same way as second foam strips 116 are so provided.

FIG. 16 shows the essential steps of the possible first production method, which can follow the steps of FIG. 1 or FIG. 2. In principle, it is possible that second foam strips 116 equipped with at least one film strip 130 may have been prefabricated already, e.g., at some other location or by another manufacturer, and that they are used simply in this finished form within the scope of the production method. This also applies to first foam strips 114.

In the exemplary embodiment shown in FIG. 16, a second foam strip 116 and a first foam strip 114 of flexible foam are assembled in such a way that a foam-barrier layer web 70 is formed, in which a barrier layer 30 is arranged between adjacent foam strips 114, 116. Foam strip 116 is for this purpose preferably rotated 90° around its longitudinal axis by a suitable deflecting device, wherein the longitudinal axis extends in a third conveying direction V3. As a result of this rotation, film strip 24 is now on a side surface of foam strip 116 facing foam strip 114. As soon as they have been assembled, second foam strip 116 and first foam strip 114 are moved further along jointly in conveying direction V3. It is also possible to assemble several second foam strips 116 with one or more first foam strips 114, or several first foam strips 114 can be assembled with one or more second foam strips 116. The at least one second foam strip 116 can also be provided in such a way that no rotation of second foam strip 116 is necessary. The important point in all cases is that the side surface of second foam strip 116 equipped with film strip 130 must face adjacent first foam strip 114.

After foam strips 114, 116 have been assembled, the bonding of foam strips 114, 116 requires additional measures. In a bonding unit 36, the step of applying heat and possibly a step of pressing foam strips 114, 116 against each other are carried out. A preferred configuration of bonding unit 36 is described in greater detail below with reference to FIG. 18. Heating device 43 present in any case in bonding unit 36 is specifically set up to bond only the upper and lower edge areas of foam strips 114, 116 firmly together, in that the location of the heat source, the temperature, and/or the heating time is adjusted accordingly.

In all cases, after foam strips 114, 116 have been assembled and bonded to each other, film strip 130 forms barrier layer 30.

Foam-barrier layer web 70 can now be impregnated, for example, to delay its recovery. For this purpose, an impregnation unit 44 can be used, for example, which is followed by a drying unit 49, as will be described in greater detail below with reference to FIG. 19. The impregnation step can also be carried out at other points of the production process, however, or it can even be omitted entirely.

After assembly and the bonding of at least one second foam strip 116 to at least one first foam strip 114 to obtain a foam-barrier layer web 70 and the optional impregnation, a common adhesive layer 80 is applied to all of foam strips 114, 116 of foam-barrier layer web 70. Common adhesive layer 80 is applied to a surface of foam-barrier layer web 70 which is perpendicular to the at least one barrier layer 30.

Adhesive layer 80 is preferably provided on a supply roll 76 and is applied to foam-barrier layer web 70 in the area of an application station, indicated schematically here by the roller 78, where it is preferably pressed down or rolled down firmly. The use of a double-sided adhesive tape strip as adhesive layer 80 is especially suitable. This has the advantage that it is easy to apply to foam-barrier layer web 70, and simultaneously an adhesive surface is provided on the side facing away from foam-barrier layer web 70, by means of which sealing tape 2 can be attached to a frame profile of a window during installation. This second adhesive surface of the double-sided adhesive tape strip on the side facing away from foam-barrier layer web 70 is lined initially with a peel-off film 81 to prevent it from sticking to anything during further processing. Adhesive layer 80 can also contain textile fabric or non-woven layers.

After common adhesive layer 80 has been applied to all foam strips 114, 116 of foam-barrier layer web 70, the web is compressed and wound up into a sealing tape roll 1. One or more pairs of compression rollers 84, for example, can be used to compress the web. Alternatively or in addition, a compression roller (not shown) can also cooperate directly with sealing tape roll 1 as sealing tape 2 is being wound up into a roll.

In an alternative exemplary embodiment, a foam-barrier layer web 70 consisting of a plurality of foam strips 116 and barrier layers 30 and a foam strip 114 can be compressed and wound up into a wide roll (not shown) after the application of a common adhesive layer 80; this wide roll is then cut by means of at least one knife or at least one saw into sealing tape rolls 1 of the desired width, as will be described in greater detail below on the basis of FIG. 20.

Depending on the arrangement of the subsections of the production line, the conveying directions V1, V2, and V3 can be the same or different.

FIGS. 17-20 show a second exemplary embodiment of a possible production method for the embodiments of the sealing tape according to FIGS. 1 and 9 but pertain especially to the sealing tape according to FIG. 4.

Figure 17:
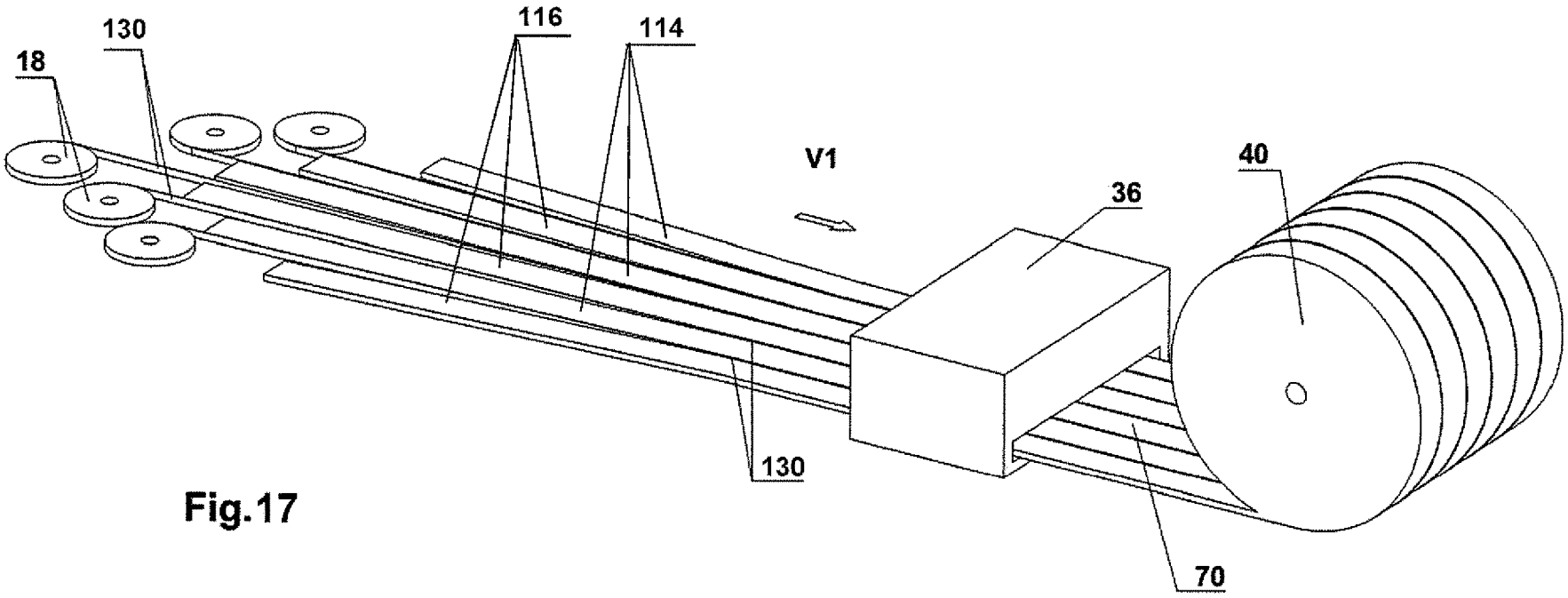
FIGS. 17-21 show alternative production steps for one embodiment of the sealing tape according to the invention.

Foam strips 114, 116 are again to be provided prior to the steps shown in FIG. 17. These foam strips 114, 116 can be produced in the same way as foam strips 114 in FIG. 15. Foam strips 114, 116 can be of different widths, but preferably they are all of the same width.

A desired number of individual foam strips 114, 116 is now assembled by suitable traction means and guide elements. Film strip 130, furthermore, is introduced into the intermediate space between each pair of adjacent foam strips 114, 116. Each film strip 130 is for this purpose preferably provided in the form of a coil 18 or roll and is preferably introduced into the intermediate space by suitable guide elements. Each coil 18 can be arranged in any desired position relative to foam strips 114, 116, wherein each film strip 130 will always be introduced essentially in the conveying direction V1 into the associated intermediate space. Deflecting elements such as deflecting shoulders or deflecting pulleys can also be used. It is also conceivable that a film web (preferably in the form of a roll) can be provided, and that this could be cut into individual film strips 130, which are then introduced into the intermediate spaces between foam strips 114, 116.

It is also conceivable that each coil 18 could be arranged in such a way that film strip 130 can be introduced into the associated intermediate space without being deflected. In addition, it is possible for film strip 130 to be provided and introduced in any other suitable form such as strips of predetermined length.

After film strip 130 has been introduced into the intermediate space between each pair of adjacent foam strips 114, 116, all of film strips 130 are bonded to two adjacent foam strips 114, 116, preferably in the area of bonding unit 36. The bonding step usually comprises in general a step of applying heat and possibly a step of pressing foam strips 114, 116 against each other. To bond film strip 130 to foam strips 114, 116, film strip 130 preferably comprises a solid layer of a hot-melt adhesive on both sides.

In principle, foam-barrier layer web 70 is produced which comprises at least one barrier layer 30 originating from film strip 130.

Figure 18:
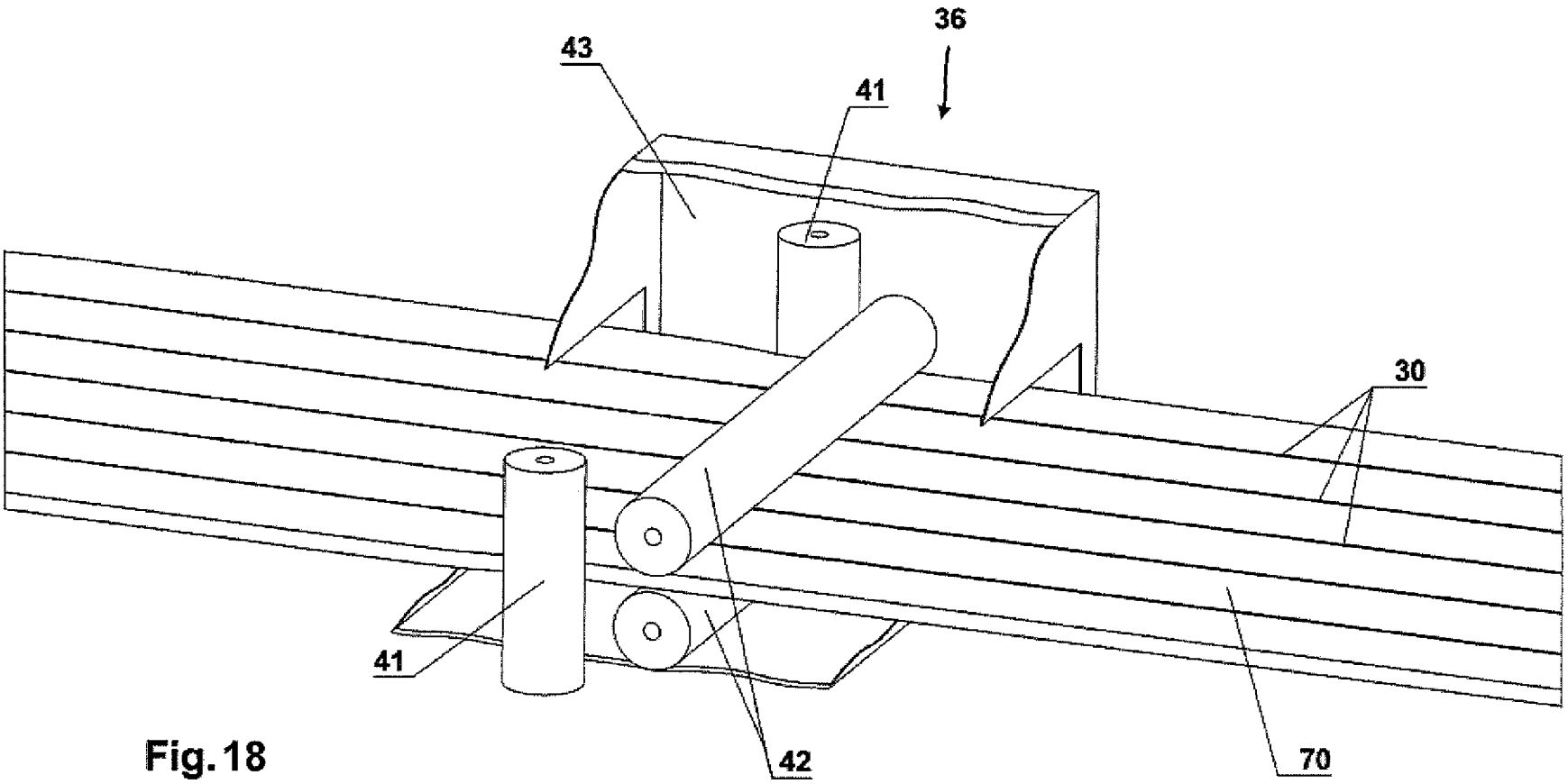

FIG. 18 shows a view of a detail of a possible bonding unit 36. Bonding unit 36 preferably comprises a pair of pressing rollers 41, which are arranged on the two narrow sides of foam-barrier layer web 70 and which press individual foam strips 114, 116 against each other. Each of the pressing rollers 41 is preferably rotatably supported around a vertical axis, wherein two pressing rollers 41 rotate in opposite directions. A pair of traction rollers 42 is also preferably arranged in bonding unit 36; these rollers extend across the width of foam-barrier layer web 70 and form a gap through which foam-barrier layer web 70 passes. Two traction rollers 42 are driven in opposite directions around a horizontal axis, and they thus pull foam-barrier layer web 70 through bonding unit 36. Such pairs of traction rollers 42 can also be used at other points of the production process. In bonding unit 36, traction rollers 42 could also be arranged upstream of pressing rollers 41.

In all cases bonding unit 36 comprises a heating device 43, which is merely suggested in FIG. 18. Heating device 43 can preferably comprise a housing, which surrounds foam-barrier layer web 70. Heating device 43 can be configured to produce heat in any desired way. Heating device 43 can be used in combination with pressing rollers 41. It is also possible to provide only heating device 43 in bonding unit 36. Heating device 43 is specifically set up to bond only the upper and lower edge areas of foam-barrier layer web 70 permanently together, in that the location of the heat source, the temperature, and/or the heating time is adjusted accordingly.

Downstream from bonding unit 36, foam-barrier layer web 70 can be wound up into a supply roll. It is also possible, however, for foam-barrier layer web 70 to be sent continuously to the further processing steps. As a result, the number of steps occurring successively in the production line can be varied, and thus the length of the individual subsections of the production line can be adapted as appropriate to the amount of space available.

Figure 20:
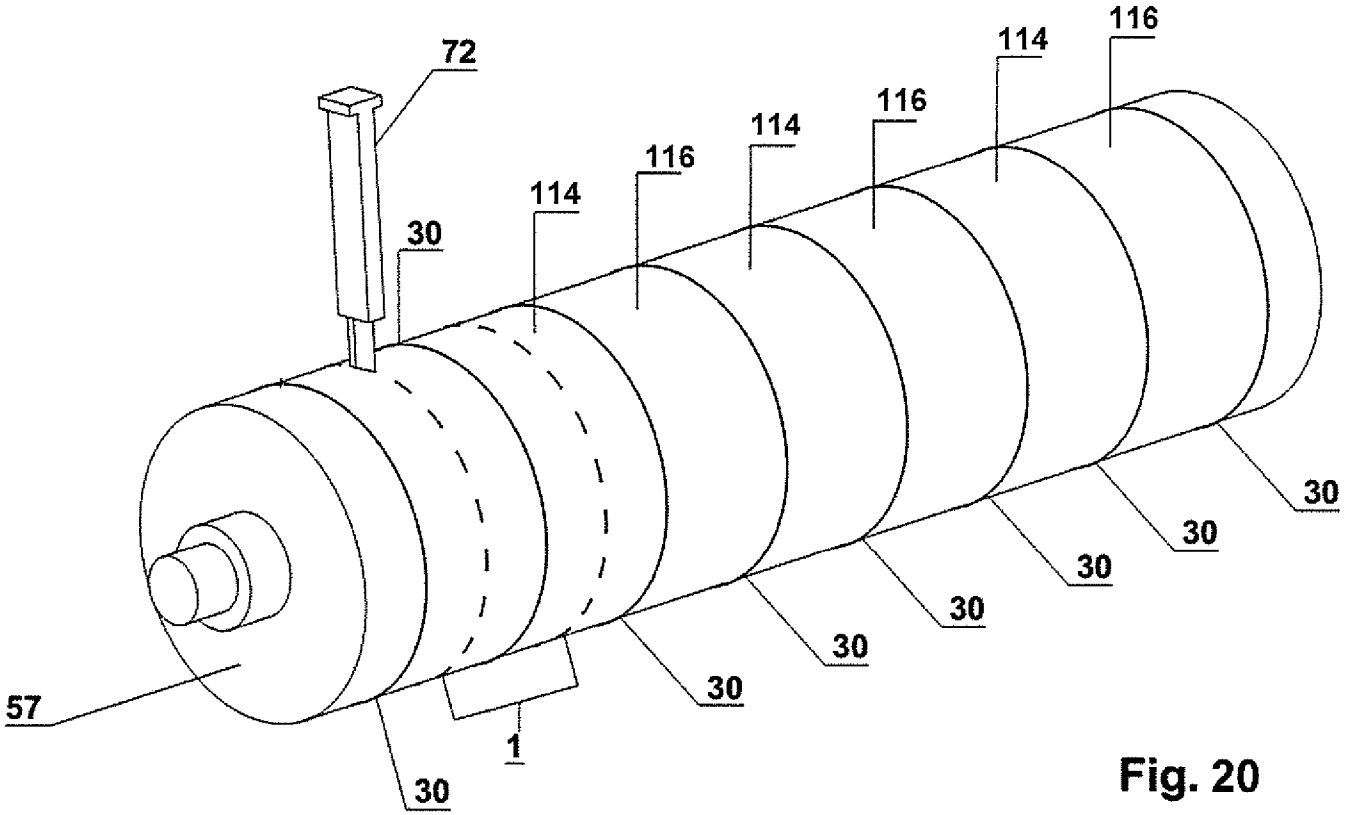

If foam strips 114, 116 have already been impregnated previously or if sealing tape is to remain unimpregnated, intermediate roll 57 of FIG. 20 or even the end product itself, i.e., sealing tape roll 1, can be obtained right at this point.

Figure 19:
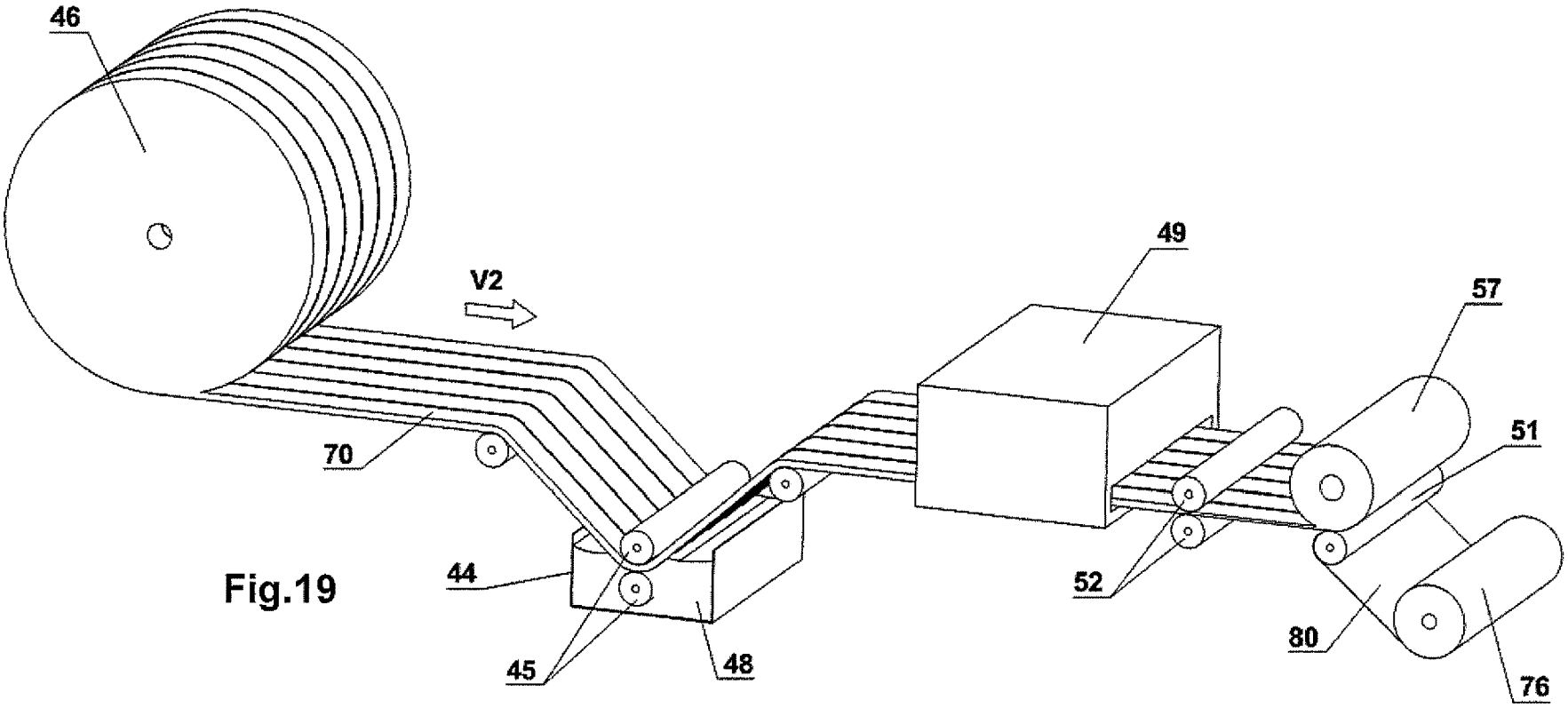

If this is not the case, then the additional steps of the second production method are carried out as shown in FIG. 19. For this purpose, foam-barrier layer web 70, previously wound up into a supply roll 40, is first unwound again. In the exemplary embodiment shown in FIG. 19, foam-barrier layer web 70 is guided in the next step through an impregnation unit 44 in a second conveying direction V2, which, depending on the arrangement of the subsections of the production line, can be the same as or different from V1. Two rollers 45 guide foam-barrier layer web 70 into a bath of a suitable impregnation agent 48, and foam becomes completely saturated with the impregnation agent. Conventional impregnation agents and methods for impregnating foams are known to the person skilled in the art. Foam-barrier layer web 70 is preferably compressed between rollers 45 so that the subsequent recovery of the foam supports the uptake of impregnation agent 48. After the impregnation in impregnation unit 44, impregnated foam-barrier layer web 70 is dried in a drying unit 49. In this unit, impregnated foam-barrier layer web 70 is dried by known means, e.g., by a hot-air blower or radiant heater. Then foam-barrier layer web 70 is wound up into an intermediate roll 57, preferably by the use of compression rollers 51, 52. It can be sufficient to use only one compression roller 51 directly at the transition to intermediate roll 57, or a pair of compression rollers 52 can be used beforehand to compress foam-barrier layer web 70. In the example shown, both options are used in combination. Foam-barrier layer web 70 on intermediate roll 57 is in a highly compressed state.

If no heating device 43 was used previously, drying unit 49 following impregnation unit 44 can, in a special embodiment, also function as a heating device for the permanent bonding of all the elements of foam-barrier layer web 70. In this way, it would be possible to eliminate a heating step. This also applies to the embodiment according to FIG. 16.

In addition, an adhesive layer 80 such as double-side adhesive tape lined on one side with a peel-off film is preferably also applied to foam-barrier layer web 70. Adhesive layer 80 is again stored in the form of a supply roll 76 or a supply coil and is pulled from it. The application of adhesive layer 80 to foam-barrier layer web 70 is preferably done simultaneously with the winding-up of foam-barrier layer web 70 into intermediate roll 57, wherein compression roller 51 produces the pressure required to bond adhesive layer 80 to foam-barrier layer web 70.

The impregnation of the foam can also be carried out at other points of the production method. The impregnation of the foam, furthermore, can be completely omitted, or it can already have been done before foam strips 114, 116 are provided. The impregnation of the foam preferably takes place, however, after the introduction of film strip 130 into the intermediate space between each pair of adjacent foam strips 114, 116, because each film strip 130 adheres better to foam which has not been impregnated and can therefore be bonded more effectively to it.

According to the variant of the second production method as illustrated in FIG. 20, intermediate roll 57 is cut in the axial direction at one or more points to produce a plurality of sealing tape rolls 1, which are less wide than intermediate roll 57. Cutting of intermediate roll 57 is preferably carried out by one or more parallel saws 72. Only one saw 72 is shown in FIG. 20, and an additional parallel cut for cutting intermediate roll 57 is indicated in broken line. Here, too, other suitable methods for cutting the roll can also be used (e.g., knives, heated wires, laser cutting devices, water-jet cutting devices).

Intermediate roll 57 is cut into sealing tape rolls 1 in such a way that foam strips 114, 116 and the at least one barrier layer 30 alternate in the axial direction of sealing tape roll 1. In a sealing tape roll 1, each radially-extending barrier layer 30 is accommodated between two foam strips 114, 116, as a result of which sealing tape 2 provides a more effective seal against drafts and/or the diffusion of water vapor, and each barrier layer 30 is simultaneously protected from external damage. For reasons of clarity, the preferably provided double-sided adhesive layer 80 lined with peel-off film is not shown here.

In the exemplary embodiment of FIG. 20, sealing tape rolls 1 with exactly one barrier layer 30 are produced. Sealing tape rolls 1 with multiple inner barrier layers 30 can also be produced. In this case, barrier layers 30 of a sealing tape 2 can comprise different resistances to the diffusion of water vapor. For the formation of barrier layers 30, film strips 130 can be used whose vapor diffusion resistance is adapted variably to the environmental conditions. The step of cutting intermediate roll 57 into individual sealing tape rolls 1 can also be omitted if the entire intermediate roll 57 is already intended to be used as a sealing tape roll 1. In this case, it can nevertheless also be effective, for the sake of a smoother outer surface of sealing tape roll 1, to cut off the edge areas of intermediate roll 57. Otherwise, sealing tape roll 1 is produced as shown by way of example on the right in FIG. 16.

Figure 21:
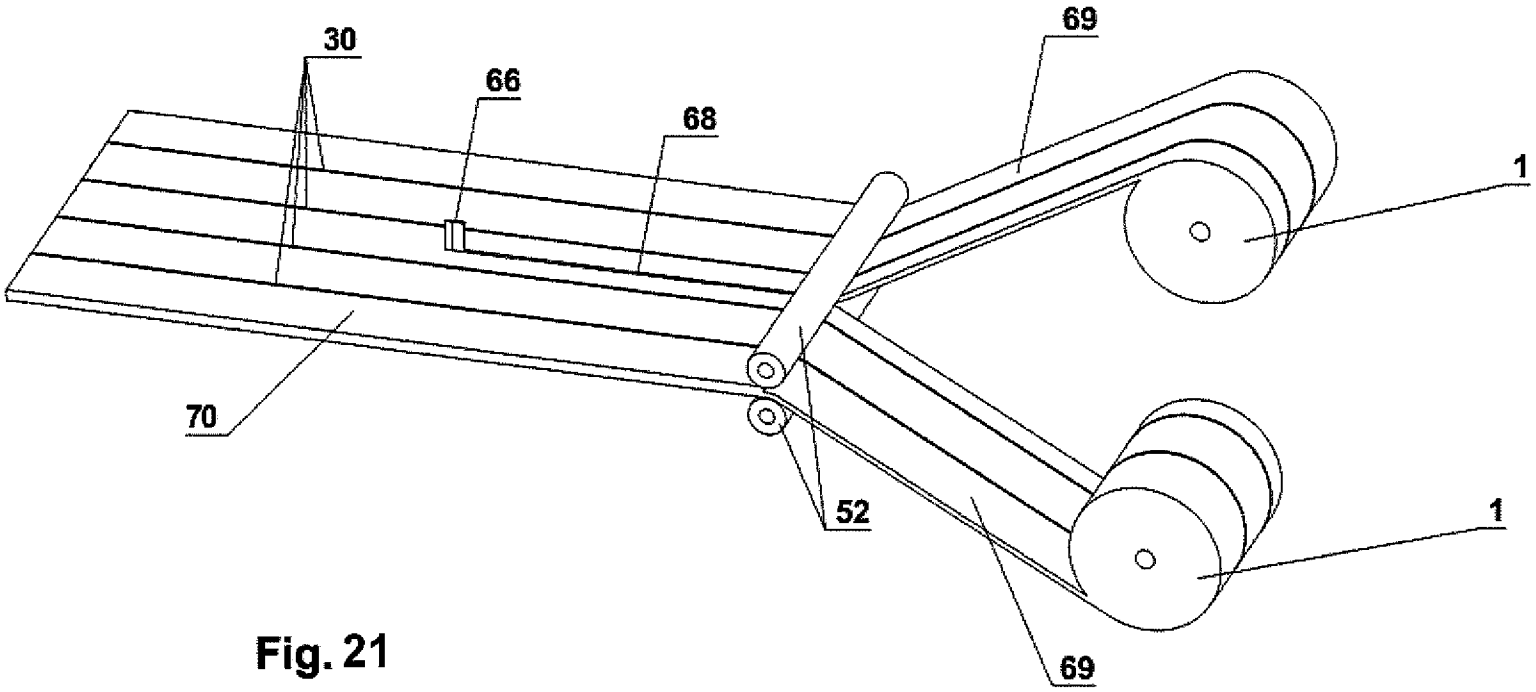

FIG. 21 shows another alternative possibility for the final processing of foam-barrier layer web 70 for the production of sealing tape rolls 1. In addition to the variant shown on the right in FIG. 19, foam-barrier layer web 70 can also be cut in the longitudinal direction by one or more knives 66 or saws in the area of at least one foam strip 114, 116. As a result, at least one cut 68 is made into foam-barrier layer web 70, as a result of which at least two foam-barrier layer strips 69 are obtained. Each foam-barrier layer strip 69 can then be wound up into a finished sealing tape roll 1. In addition, a double-sided adhesive layer 80 lined with a peel-off film as shown in FIG. 19 (not shown in FIG. 21) is preferably also applied. In this way, the step of cutting up an intermediate roll 57 into pieces as shown in FIG. 20 can be omitted. Here, too, compression rollers 52 can preferably be used to pre-compress the individual foam-barrier layer strips 69.

Figure 22:
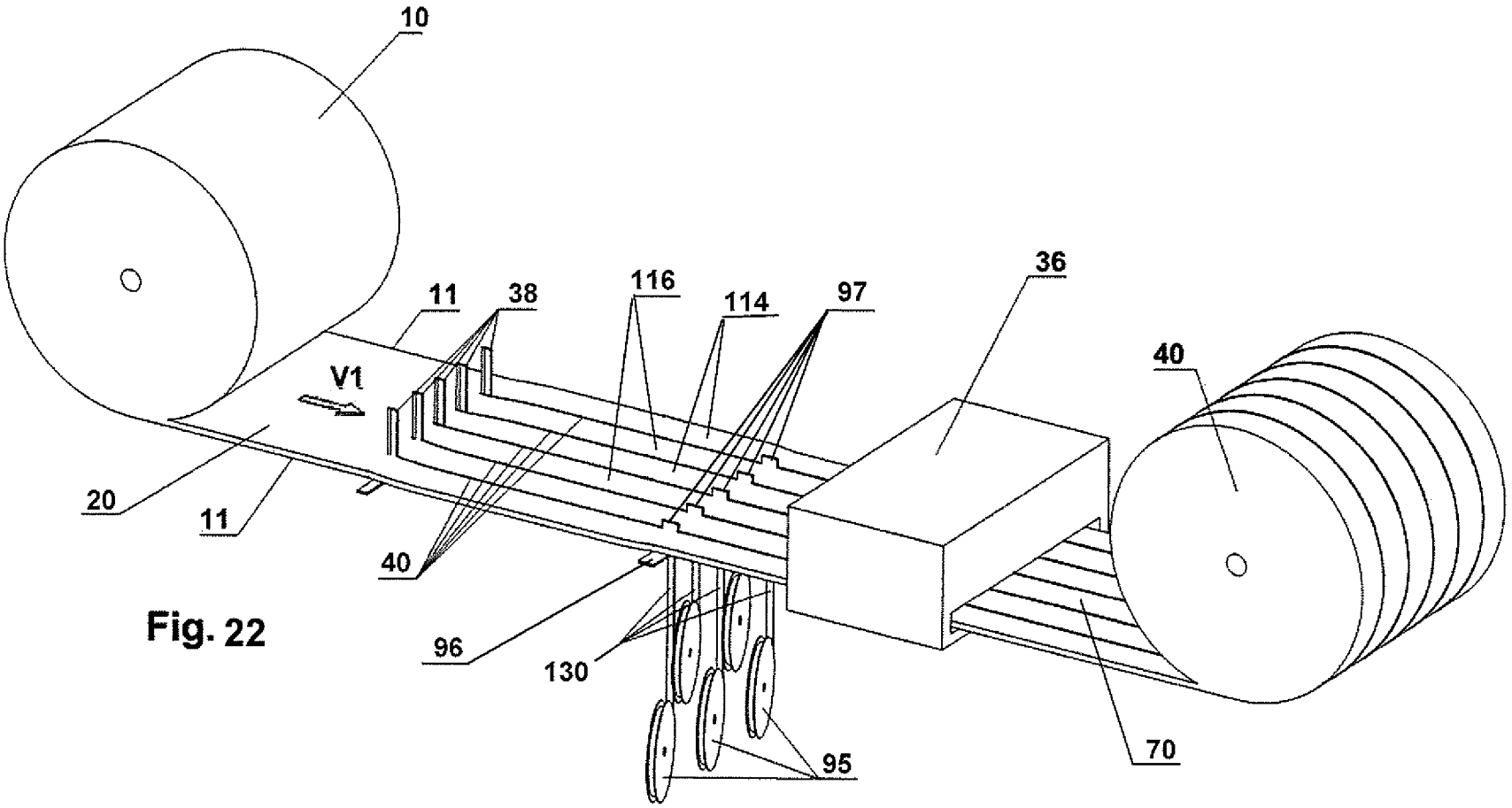
FIG. 22 shows a first alternative production step for one embodiment of the sealing tape according to the invention.

As an alternative to the introduction of film strips 130 between two foam strips 114, 116, the variant shown in FIG. 22 can also be used. Here a foam web 20 is first unwound from the starting roll 10 and moved in a conveying direction indicated by the arrow V1. By means of at least one knife 38, preferably several parallel knives 38, at least one continuous cut 40, preferably several parallel continuous cuts 40, are introduced into the foam web 20 in a longitudinal direction of the foam web 20, preferably parallel to longitudinal edges 11 of foam web 20. Longitudinal edges 11 are the edges of foam web 20 which are parallel to the conveying direction V1 and are at a right angle to the axial direction of starting roll 10. To introduce the at least one cut 40 into foam web 20, it is possible to use any of the methods known to persons skilled in the art for cutting foam webs 20 instead of knives 38.

Each continuous cut 40 produces an intermediate space between two adjacent foam strips 114, 116. In a subsequent step, a film strip 130 is introduced into each intermediate space. Each film strip 130 is preferably provided for this purpose on a coil 95 or a roll and is preferably introduced into the intermediate space by way of at least one deflecting element 96. Each coil 95 can therefore be oriented in any position relative to foam web 20, wherein each film strip 130 will always be deflected by the associated deflecting element 96 and introduced into the associated intermediate space in essentially the conveying direction V1. Deflecting shoulders, for example, or deflecting pulleys can be used as deflecting elements 96. It is also conceivable that a film web (preferably in the form of a roll) could be provided, and that it could be cut longitudinally into individual film strips 130, which are then introduced into intermediate spaces between foam strips 114, 116.

Because individual foam strips 114, 116 rest closely against each other, it is advantageous with respect to the insertion of film strip 130 for each intermediate space to be widened beforehand by a spreading element 97. As spreading elements 97, it is possible to use, for example, projections in the form of a ship's prow, which expand in the conveying direction V1. In the exemplary embodiment shown, deflecting elements 96 are configured as integral parts of spreading elements 97, but they can also be separate components.

It is also conceivable that each coil 95 could be arranged in such a way that film strip 130 can be introduced into the associated intermediate space without deflection. It is also possible for film strip 130 to be provided and introduced in any other suitable form such as strips of predetermined length.

After film strip 130 has been introduced into intermediate space between two adjacent foam strips 114, 116, all of film strips 130 are bonded to two adjacent foam strips 114, 116, preferably in the area of a bonding unit 36 as before. Heating device 43 present in all cases in bonding unit 36 is specifically set up to bond only the top and bottom edge areas of foam strips 114, 116 firmly together, in that the location of the heat source, the temperature, and/or the heating time is adjusted as appropriate.

The two variants described on the basis of FIGS. 14-16 and in FIGS. 17-21 differ only with respect to the production of foam-barrier layer web 70. After that, all of the additional processing steps can be carried out in identical fashion. In all of the production examples, wider intermediate rolls 57 can be produced, which are then divided into individual sealing tape rolls 1 (see FIG. 20). Narrow sealing tape rolls 1 can also be produced directly in all of the production examples without the need to produce a wide intermediate roll 57 (see FIG. 16). The variant of FIG. 21 is also possible in all of the production examples.

In addition to the tensile forces caused by the downstream winding-up process, all of the foam webs, foam strips, foam-barrier layer webs, or foam-barrier layer strips are preferably moved forward by rollers, especially preferably by pairs of counter-rotating rollers. Traveling belts can also be used. Such transport means can also be used for the film strips and film webs.

The heating devices mentioned in the exemplary embodiments are usually configured as hot-air blowers. Radiant heating can also be considered, however, such as heating by means of infrared heaters or microwave heaters.

The invention claimed is:

1. A sealing tape for sealing a joint comprising:

two longitudinal side surfaces extending in a longitudinal direction of the sealing tape, wherein a direction transverse to the side surfaces defines a functional direction of the sealing tape;

at least first and second separate foam strips of a flexible foam capable of recovery after compression and arranged next to each other in the functional direction of the sealing tape, wherein each of the first and second foam strips comprises a top surface, a bottom surface, and an inner side surface facing the other foam strip; and a film strip, which is arranged between the first foam strip and the second foam strip in such a way that it reduces permeability to vapor diffusion of the sealing tape in the functional direction;

wherein a longitudinal pocket, which extends in the longitudinal direction of the sealing tape and which is completely enclosed on all four sides when viewed in a cross-sectional view perpendicular to the side surfaces, is formed between the first foam strip and the second foam strip; wherein in the functional direction of the sealing tape, the pocket is arranged between the film strip and the second foam strip; and wherein the pocket is filled with an additional material which is selected from a group consisting of pourable or liquid materials, materials for fire protection, hygienic materials, and materials for initiating the expansion of sealing tape.

2. The sealing tape of claim 1 wherein the film strip is bonded to both, the first and second foam strip.

3. The sealing tape of claim 1 further comprising adhesion sites arranged between the film strip and the first foam strip at at least one of an upper area of the first foam strip, the top surface of the first foam strip, and the inner side surface of the first foam strip near the top surface of the first foam strip, and further at at least one of a lower area of the first foam strip, the bottom surface of the first foam strip, and the inner side surface of the first foam strip near the bottom surface of the first foam strip, whereas, in an intermediate area between the upper area and the lower area of the first foam strip, the film strip is not bonded to the first foam strip.

4. The sealing tape of claim 3 wherein the adhesion sites between the film strip and the first foam strip are arranged only on the inner side surface of the first foam strip near the top surface of the first foam strip and on the inner side surface of the first foam strip near the bottom surface of the first foam strip.

5. The sealing tape of claim 3 wherein the longitudinal pocket is formed at a level of the intermediate area of the first foam strip.

6. The sealing tape of claim 1 wherein the pocket is enclosed by the film strip and the first foam strip.

7. The sealing tape of claim 2 wherein an entire surface of the film strip is bonded to the inner side surface of the second foam strip.

8. The sealing tape of claim 1 wherein the film strip is bonded to the top surface and to the bottom surface of the second foam strip.

9. The sealing tape of claim 1 wherein adhesion sites between the film strip and the second foam strip are arranged only on the inner side surface of the second foam strip near the top surface of the second foam strip, and on the inner side surface of the second foam strip near the bottom surface of the second foam strip.

10. The sealing tape of claim 1 wherein an entire surface of the film strip is bonded to the inner side surface of the second foam strip, and adhesion sites between the film strip and the first foam strip are arranged on the top surface and the bottom surface of the first foam strip.

11. The sealing tape of claim 3 wherein the adhesion sites are formed as longitudinal adhesive lines.

12. The sealing tape of claim 3 wherein the adhesion sites are formed by melting and solidifying a bonding material.

13. The sealing tape of claim 12 wherein the bonding material is an adhesive.

14. A sealing tape for sealing a joint comprising:

two longitudinal side surfaces extending in a longitudinal direction of the sealing tape, wherein a direction transverse to the side surfaces defines a functional direction of the sealing tape;

at least first and second separate foam strips of a flexible foam capable of recovery after compression and arranged next to each other in the functional direction of the sealing tape, wherein each of the first and second foam strips comprises a top surface, a bottom surface, and an inner side surface facing the other foam strip;

a first film strip, which is arranged between the first foam strip and the second foam strip in such a way that it reduces permeability to vapor diffusion of the sealing tape in the functional direction;

a second film strip, which is arranged between the first foam strip and the second foam strip;

wherein a longitudinal pocket, which extends in the longitudinal direction of the sealing tape and which is completely enclosed on all four sides when viewed in a cross-sectional view perpendicular to the side surfaces, is formed between the first foam strip and the second foam strip; wherein in the functional direction of the sealing tape, the pocket is arranged between the first film strip and the second film strip; and wherein the pocket is filled with an additional material which is selected from a group consisting of pourable or liquid materials, materials for fire protection, hygienic materials, and materials for initiating the expansion of sealing tape.

15. The sealing tape of claim 14 further comprising adhesion sites arranged between the first film strip and the second film strip, wherein the adhesion sites are arranged only in an area near the top surface of the first foam strip and in an area near the bottom surface of the first foam strip.

16. The sealing tape of claim 15 wherein the first film strip and the second film strip are not bonded to each other in an intermediate area between the adhesion sites.

17. The sealing tape of claim 16 wherein the longitudinal pocket is formed at a level of the intermediate area.

18. The sealing tape of claim 14 wherein the pocket is enclosed by the first film strip and the second film strip.

19. The sealing tape of claim 14 wherein an entire surface of the first film strip is bonded to the inner side surface of the first foam strip.

20. The sealing tape of claim 14 wherein an entire surface of the second film strip is bonded to the inner side surface of the second foam strip.

21. The sealing tape of claim 14 wherein the first film strip is bonded to the top surface and to the bottom surface of the first foam strip.

22. The sealing tape of claim 14 wherein the second film strip is bonded to the top surface and to the bottom surface of the second foam strip.

23. The sealing tape of claim 15 wherein the adhesion sites are formed as longitudinal adhesive lines.

24. The sealing tape of claim 15 wherein the adhesion sites are formed by melting and solidifying a bonding material.

25. The sealing tape of claim 24 wherein the bonding material is an adhesive.

* * * * *